United States Patent [19]

Lee

[11] 4,203,017

[45] May 13, 1980

[54] ELECTRIC SWITCH

[75] Inventor: James Lee, Flanders, N.J.

[73] Assignee: Integrated Electronics Corporation, Dover, N.J.

[21] Appl. No.: 927,500

[22] Filed: Jul. 24, 1978 (Under 37 CFR 1.47)

[51] Int. Cl.[2] ..... H01H 1/22; H01H 3/00

[52] U.S. Cl. ..... 200/339; 200/153 G; 200/244

[58] Field of Search ..... 200/339, 153 G, 73, 200/239, 244, 275, 315

[56] References Cited

U.S. PATENT DOCUMENTS

| | | | |
|---|---|---|---|
| 2,749,400 | 6/1956 | Chichester | 200/153 G X |
| 3,225,156 | 12/1965 | Sahrbacker | 200/339 X |
| 4,115,673 | 9/1978 | Smith | 200/315 |
| 4,121,068 | 10/1978 | Peck | 200/339 X |
| 4,121,071 | 10/1978 | Campbell et al. | 200/315 X |

*Primary Examiner*—Steven M. Pollard

*Attorney, Agent, or Firm*—H. Hume Mathews

[57] ABSTRACT

A rocker type electric switch operated by pressure on a knob which actuates a spring biased plunger that exerts a switch closing force on a movable switch contact element, in combination with means for preventing said plunger from forcing said element to the switch closed position until the knob and plunger have been rotated through a predetermined angle to a preselected position.

3 Claims, 9 Drawing Figures

FIG. 1
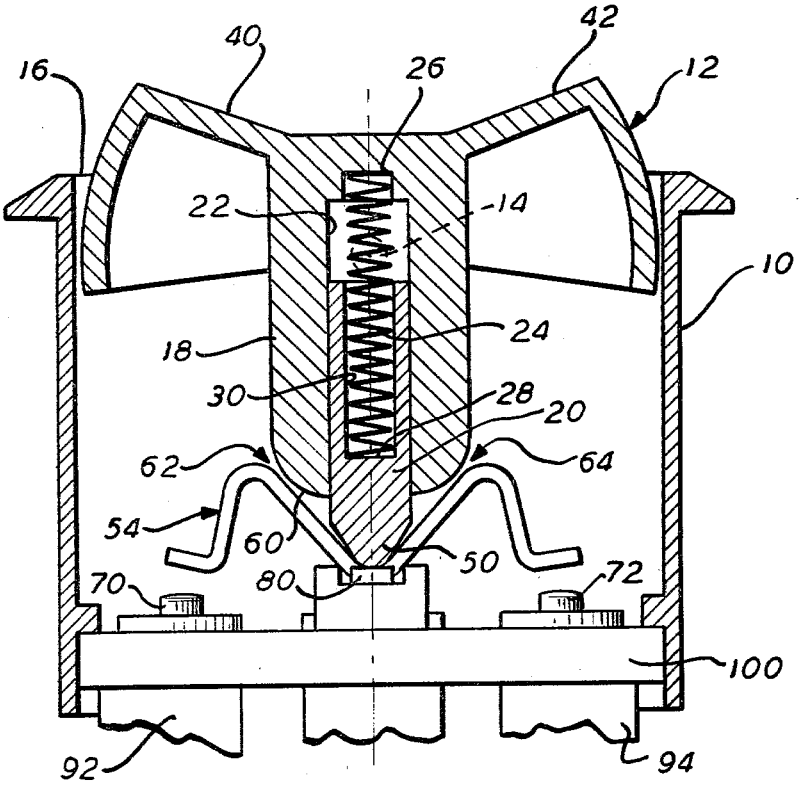
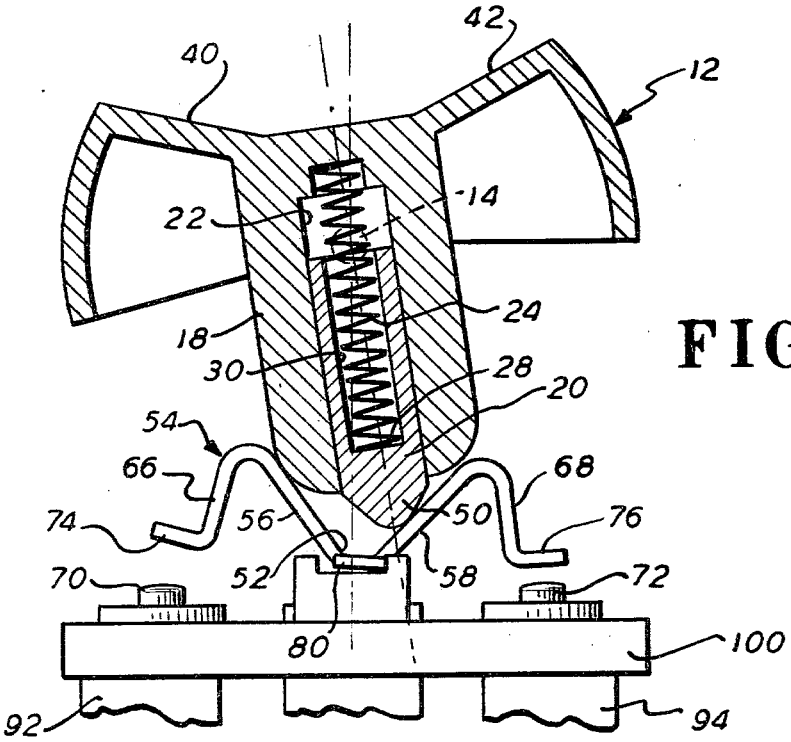
FIG. 2

FIG. 3
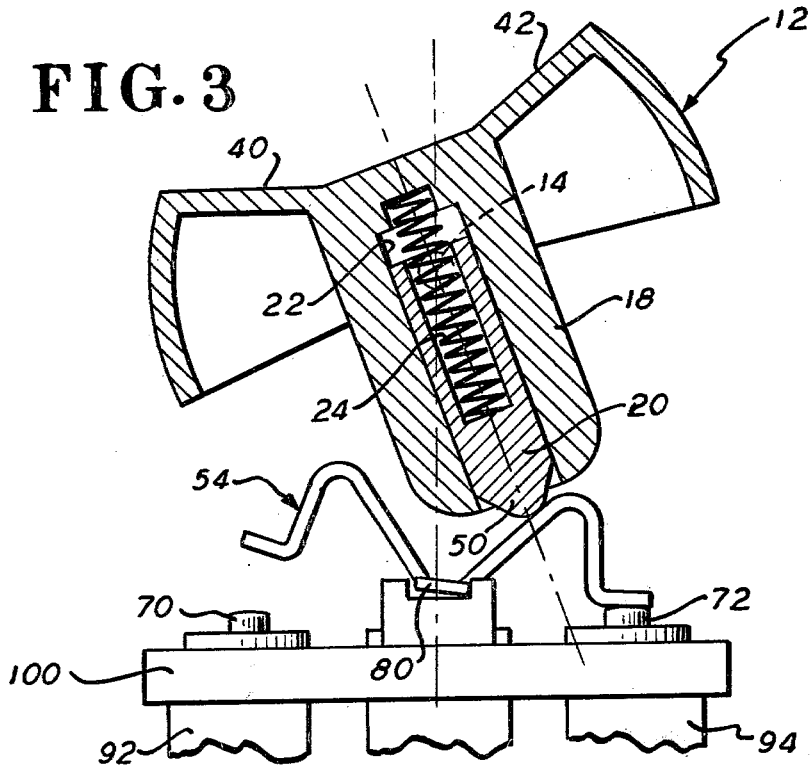
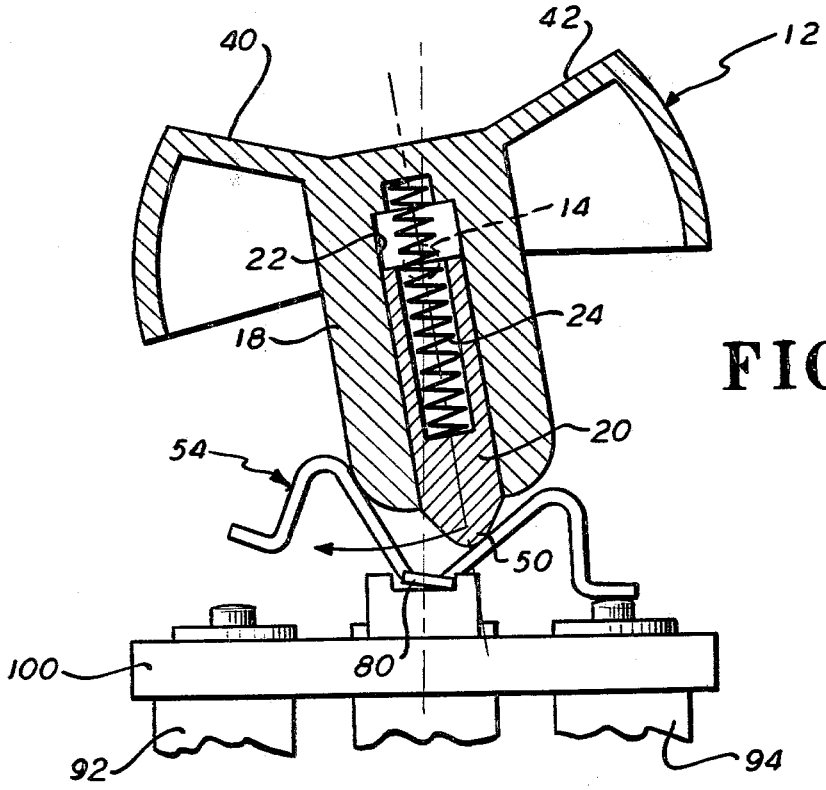
FIG. 4

ELECTRIC SWITCH

BACKGROUND OF INVENTION

This invention relates to rocker type electric switches, and more particularly to a rocker type electric switch designed for automotive application, such as for use to control the flow of current to the heating elements of a rear window defogger.

Rocker type electric switches are known in the prior art. They have the advantage of being cheaper to construct than other types of switches but they also have faults. One such fault found in the rocker switches of the prior art is that the switch will close too soon, and uncontrollably, following initial actuation of the knob that is pressed to open or close the switch. In prior art switches, of the rocker type, the switch contact element is freely movable to closed position in response to pressure thereon by the actuating plunger when the knob is pressed. Therefore the switch contact element can close uncontrollably, at any position of the knob and plunger, as soon as the knob is pressed. This fault may result in the switch closing when the knob is touched accidentally, with no intent to operate the switch, and it also tends to cause more frequent "welding" of the switch contacts in closed position as a result of arcing between the contacts at the time the switch closes, before it comes into fully closed position.

Prior art type rocker switches have been provided with lugs or similar means for assuring opening of the switch at a particular position of the actuating knob. But the prior art does not disclose the combination of the present invention whereby quick, positive and forceful switch closing at a particular knob position is provided, in addition to positive switch opening.

Examples of rocker type switches known in the prior art are shown in the following U.S. Pat. Nos. 2,874,338; 2,927,983; 3,646,291; 3,852,557.

SUMMARY OF INENTION

According to the present invention, a rocker type electric switch having a spring activated plunger contained in a housing which is rocked forth or back by the switch actuating knob, operates to close or open the switch contact elements through the combined action on the movable switch contact element of the plunger and the plunger housing.

The design is such that the spring activated plunger tends by force transmitted through the spring to force the movable switch contact element into contact with the fixed switch contact when the switch knob is shifted to the "switch closed" or "on" position, but at the same time a shoulder on the housing for the plunger positively restrains the switch closing movement of the moveable switch contact element until the plunger and housing have been rocked, or rotated, to the predetermined position at which it is desired that the switch close. At that point, or position, the shoulder on the housing moves away from the moveable contact element, removing the restraining force and allowing the pent up spring force of the plunger quickly and forcefully to snap the moveable switch contact into electrical contact with the fixed switch contact.

When the knob is pressed to move it to switch open position, a similar but reverse action occurs. Rotation of the housing and plunger causes the shoulder on the housing to come into engagement with the moveable switch element, creating a direct, positive, opening force on the moveable switch contact. This causes the switch contacts to snap open, even in the situation wherein they may have become stuck, or welded together, as a result of arcing at the time of closure.

The closing action of the switch is effected by the force of the end of the plunger on the moveable contact element as the plunger is rotated by pressing the knob, but such closing action is controlled by the restraining action on the moveable contact element of the shoulder on the plunger housing. Until that shoulder moves away from the moveable switch element which occurs at a predetermined, selected position, the switch cannot close.

The opening action of the switch is effected by the positive force of the shoulder on the housing when the shoulder contacts the moveable switch element as the shoulder moves in the reverse, or opposite direction. Thus the position of the shoulder on the housing determines the exact position at which the switch contacts are closed and the exact position at which they are opened. Furthermore, the shoulder in the opening operation will force the contacts to open at the predetermined position regardless of whether or not they may have become stuck or welded together.

BRIEF DESCRIPTION OF THE DRAWINGS

FIG. 1 is a vertical cross-section, partly in elevation, showing the operating mechanism of a preferred embodiment of the switch of the present invention. The operating knob and the switch contacts, are in fully open position.

FIG. 2 is a partial view like FIG. 1, but with the switch moved partway to the position wherein the right hand switch contacts will be closed.

FIG. 3 is a view like FIG. 2, but with the knob moved to final position in which the right hand switch contacts are fully closed.

FIG. 4 is a view like FIGS. 1 and 2, but with the switch knob having been moved partway back, to the position in which the right hand switch contacts will be opened.

DETAILED DESCRIPTION OF THE PREFERRED EMBODIMENT

Figure 5:
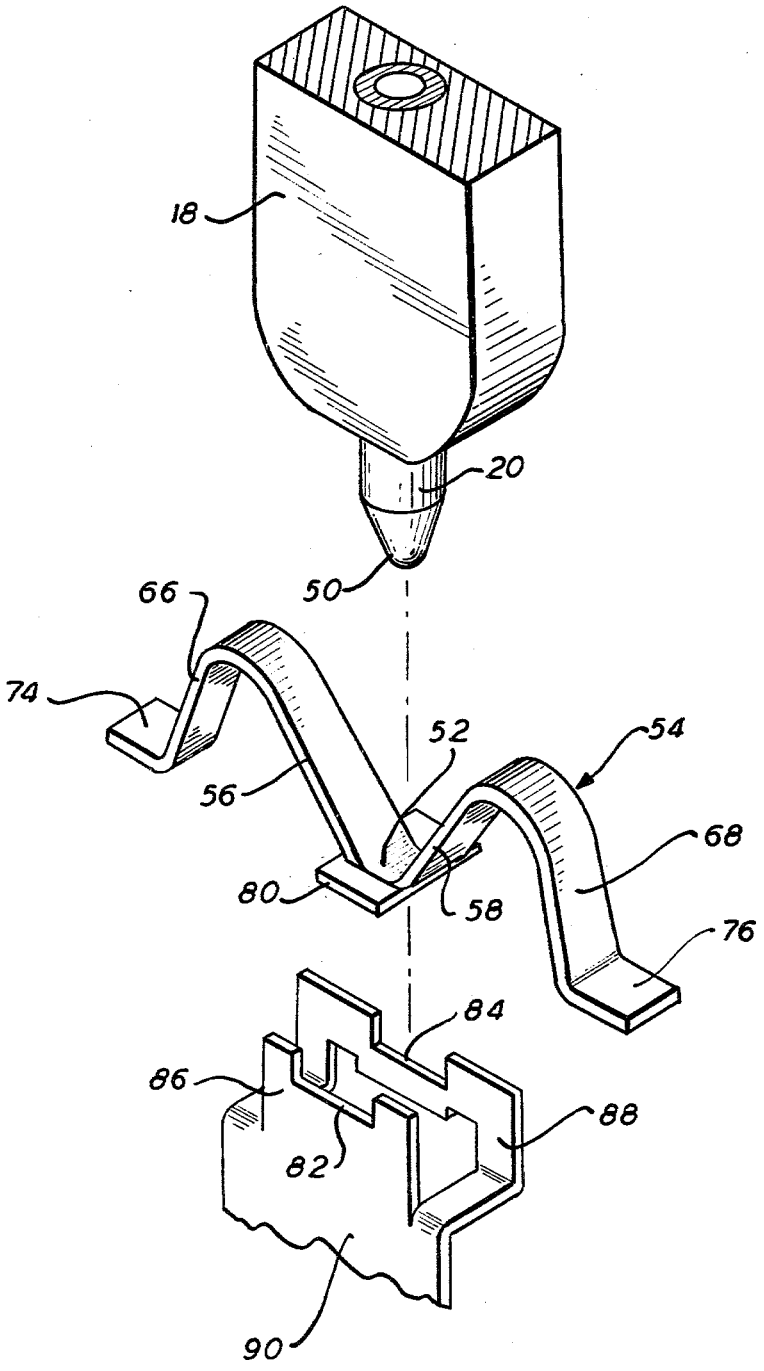
FIG. 5 is an exploded, isometric view of the switch elements of the other Figures showing the details of construction of the plunger, its housing, the moveable switch element, and the carrier or support for the moveable switch element.
Figure 6:
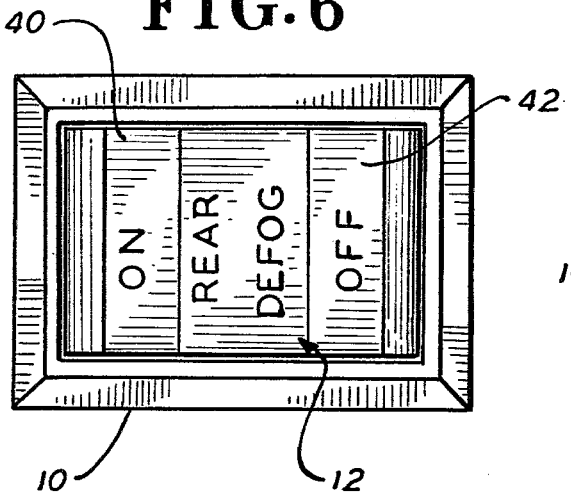
FIGS. 6 and 7 are plan or top views respectively of the switch and the switch base plate.
Figure 7:
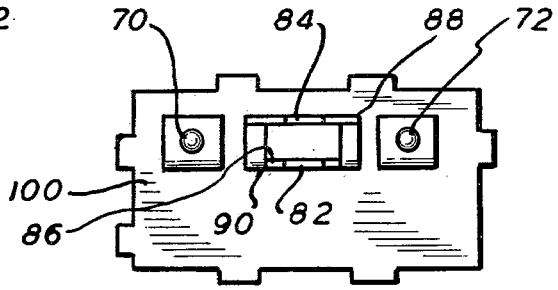

The rocker switch of the present invention as shown in FIG. 1 of the drawings comprises a molded plastic case 10 of rigid insulating material having an actuating knob 12 pivotally mounted on a pivot 14 in the top opening 16 of the case. The case, and the knob, are of generally rectangular cross-section. A plunger housing 18 is molded integrally with the knob and extends downwardly therefrom into the case. Plunger 20 is reciprocally mounted in a cylindrical bore 22 in the plunger, and a compression spring 24 compressed between the top of the bore 22 and the bottom 28 of a counterbore 30 in the plunger urges or biases the plunger 20 downwardly, in a direction to eject it from the plunger bore 22 were it not restrained, as set forth below, from such ejection.

Pressing surfaces, for receiving pressure from a thumb or finger, are provided on the two opposed top surfaces 40, 42 of the knob so that it may be rocked about pivot 14 to either the "switch on" position of the "switch off" position, as desired.

Plunger 20 has a tapered, rounded, but relatively sharp nose 50 at its lower end which fits into a socket shaped portion 52 (see FIG. 2) of a moveable contact element 54. The socket portion 52 is formed by a curved central part of element 54 lying between and joining two upstanding, diverging portions 56,58 of element 54. As best seen in FIG. 1, these upstanding portions of element 54 extend from the socket portion 52 upwardly and outwardly, on either side of the lower end 60 of housing 18, so that their respective upper ends enclose or embrace, so to speak, the lower end 60 of housing 18. However, the two upstanding portions of the moveable contact element do not, in the neutral position of the switch as shown in FIG. 1, actually touch the sides of the housing. Rather, a small clearance exists between the housing and each upstanding portion 56, 58 of the moveable contact element as shown respectively at 62, 64 in FIG. 1, when the switch knob is in the neutral position.

The two upstanding portions 56, 58 of the moveable contact element 54 are bent or curved over at their respective top portions and then extended vertically, or almost vertically downwardly, as shown at 66 and 68, to points respectively adjacent the fixed contacts 70 and 72 of the rocker switch. The moveable contact element then bends or turns outwardly at its respective ends to form contacts 74, 76 which match respectively with fixed contacts 70, 72 to form the circuit making and breaking surfaces.

Moveable contact element is, of course, made of material of high electrical conductivity and the surfaces of the various contacts 70, 72, 74 and 76 may in addition be made of special alloy, known in the art for the purpose, which will not only conduct electric current readily between contacting surfaces, but will in addition resist erosion and wear by sparking or mechanical contact.

At its central, socket portion 52, moveable contact element 54 has integral therewith a rectangular conductive bearing plate 80 (see FIG. 5) which rests in a pair of rectangular notches 82, 84 in the top edges of a pair of spaced parallel side walls 86, 88 of a conductive lug 90 molded in the base plate 100 of the case 10. The central portion of moveable contact element 54 is always in good electrical contact with lug 90 because bearing plate 80 is always pressed (by the force of spring 24) into forceful contact with the side walls 82, 84 of lug 90. Current will thus flow to or from lug 90, to which a lead or conductor is connected, by way of either the right half or the left half of moveable contact 54 depending on whether it is in the position in which contact 74 engages contact 70 or in the position in which contact 76 engages contact 72.

Fixed contacts 70, 72 are, of course, also electrically connected to lugs 92, 94 to which the other switch leads are connected. Small resistors and/or capacitors (not shown) may be connected between the various lugs to reduce sparking between the contacts when the same are opened or closed, as is known in the art.

Figure 8:
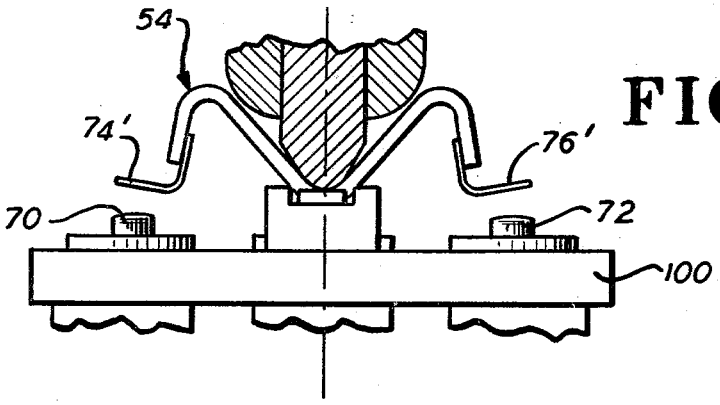
FIGS. 8 and 9 are views respectively like FIGS. 1 and 3 showing a modification of the invention in which the contact portions of the moveable switch element are made of flexible conductive metal strips.
Figure 9:
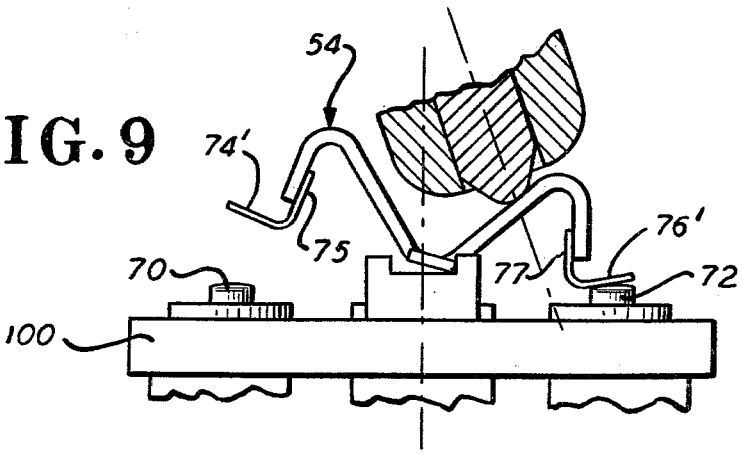

In the modification shown in FIGS. 8 and 9, the construction is the same as in the other figures except that the contacts 74', 76' are formed of flexible metal conducting strips welded or soldered to the ends of moveable contact element 54. These strips flex and bend upon engagement with the fixed contacts 70, 72 thus providing a wiping action that keeps the contacting surfaces clean, free of dirt or oxide, and will prevent them from welding together or becoming stuck upon closing. The modification of FIGS. 8 and 9 is included herein for disclosure purposes only, and is not and will not be claimed in the present application.

It is important to the invention of this application that the moveable parts consisting of knob 12, housing 18, plunger 20, and the various portions of moveable contact element 54, be positioned in a certain relationship to each other, so as to perform the successive operations illustrated in FIGS. 1, 2, 3 and 4 of the drawing. This relationship will be described in and will be apparent from the operation paragraph below.

OPERATION

In the neutral position of the switch plunger nose 50 seats in socket portion 52 of moveable contact element 54 and both moveable contacts 74, 76 are held spaced apart from the respective fixed contacts 70, 72. Both switch contacts, right and left, are in the "open" position, and no current can flow through the switch.

If an operator then presses surface 40 of knob 12, with a thumb or finger, the knob will first move to the position in FIG. 2, wherein the knob has rotated about pivot 14 to the point wherein nose 50 of plunger 20 has been forced, by contact with the upstanding portion 58 of moveable contact element 54, into bore 22 of housing 18, thereby compressing spring 24 and thereby increasing the switch closing force exerted by the plunger on the moveable contact element 54. However, at this intermediate position the switch still cannot close because, as will be seen in FIG. 2, the rounded lower end 60 of the plunger has moved into contact with the opposite upstanding portion of moveable contact element 54, closing the gap 62, thus forming a stop means preventing clockwise movement of the moveable contact element. In short, though spring 24 and plunger 20 are "cocked" in a position in which they place a strong closing force on the switch, the switch is prevented, in this intermediate position, from closing because of the larger restraining force imposed by the shoulder 60 of the housing.

Further movement of the knob will then, as shown in FIG. 3, cause shoulder 60 of housing to move away from the moveable contact element 54. When this happens spring 24 and plunger 20, the compression force of which have been even further increased by such additional knob movement, will quickly cause the right hand contact 76 on the moveable contact element to snap into engagement, and into electrical contact, with the right hand fixed contact 72. In this position the switch is fully closed, in its "right hand throw" position. So long as pressure continues to be exerted on surface 40 of knob 12 it will remain in this position. If pressure is removed from surface 40, the spring bias will cause knob 12 to return to its neutral position, shown in FIG. 1.

When the switch moves back to the neutral position, either by spring force or by spring force supplemented by pressure on surface 42, the knob and plunger 20 will rotate initially to the position shown in FIG. 4. In this position, plunger 20 and spring 24 still hold the right hand switch contacts closed, but shoulder 60 of housing 18 has moved back to a position in which it contacts, or bears against, the upstanding left hand portion 56 of the moveable contact element 54. Further clockwise movement of knob 12, in response to the spring pressure and/or by thumb or finger pressure on knob surface 42, will force the moveable contact element to rock counter-clockwise, about the axis provided by bearing plate 80, thus forcing the right hand contacts 72, 76 apart, even though they may previously have become stuck or "welded" together.

If the knob is returned only to its neutral position (FIG. 1) then the moveable contact element also will be returned to that same position. But if the pressure on the knob is continued so as to move it on past the neutral position to the "left hand throw" position (not shown) the action described above will be repeated but in the other direction, it being the right hand side of housing shoulder 60 which in this instance engages the right hand upstanding portion 58 of moveable contact element 54 that prevents closure of the contacts until the plunger and spring are fully "cocked" and the switch reaches the predetermined position in which it is designed to close or engage.

I claim:

1. In an electric switch having a rotatable knob adapted to be operated by finger pressure and which upon such operation causes a spring biased plunger to exert a switch closing force on a movable switch contact element, the improvement which comprises stop means associated with said plunger forming an abutment which is engaged by said movable switch contact element to prevent movement of said movable contact element to the switch closed position until the knob and plunger have been rotated through a predetermined angle to a preselected position.

2. An electric switch as claimed in claim 1, in which the said stop means comprises a shoulder on a housing attached to said knob, the plunger being reciprocally mounted in said housing.

3. In an electric switch having a rotatable knob adapted to be operated by finger pressure and which upon such operation causes a spring biased plunger to exert a switch closing force on a movable switch contact element, the improvement which comprises, a housing attached to said knob in which said plunger is reciprocally mounted, a shoulder on said housing forming a stop means preventing said plunger from forcing said movable contact element to the switch closed position until the knob and plunger have been rotated through a predetermined angle to a preselected position, said movable switch contact element having two upstanding arms that in the neutral position of said switch embrace, without touching, said shoulder on said housing, said movable switch contact element also having two portions extending downwardly from the tops of said arms to respective locations adjacent a pair of fixed contacts of said switch and which carry movable contacts for engagement respectively with said fixed contacts.

* * * * *